US008398072B2

(12) United States Patent
Ikeda

(10) Patent No.: US 8,398,072 B2
(45) Date of Patent: Mar. 19, 2013

(54) SHEET FEEDING APPARATUS AND IMAGE FORMING APPARATUS

(75) Inventor: Taro Ikeda, Toyko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/830,717

(22) Filed: Jul. 6, 2010

(65) Prior Publication Data

US 2011/0006474 A1 Jan. 13, 2011

(30) Foreign Application Priority Data

Jul. 10, 2009 (JP) ..... 2009-163754

(51) Int. Cl.
*B65H 3/06* (2006.01)

(52) U.S. Cl. ..... 271/117; 271/127; 271/121

(58) Field of Classification Search ..... 271/117, 271/118, 126, 127, 160, 121
See application file for complete search history.

(56) References Cited

U.S. PATENT DOCUMENTS 6,260,840 B1 7/2001 Suga et al.
6,354,584 B1 3/2002 Suga et al.
6,601,845 B2 * 8/2003 Lien et al. ..... 271/209
7,422,206 B2 * 9/2008 Okuda et al. ..... 271/121
7,513,495 B2 * 4/2009 Mo ..... 271/121
7,591,459 B2 9/2009 Matsumoto et al.
7,635,125 B2 12/2009 Ikeda
7,753,358 B2 7/2010 Ikeda
2006/0197271 A1 * 9/2006 Nakashima ..... 271/10.09
2008/0150220 A1 * 6/2008 Eltzroth et al. ..... 271/167
2008/0251999 A1 10/2008 Yamanaka et al.
2010/0090392 A1 4/2010 Ikeda
2010/0096796 A1 4/2010 Ikeda
2010/0194031 A1 8/2010 Ikeda et al.

* cited by examiner

*Primary Examiner* — Michael McCullough
(74) *Attorney, Agent, or Firm* — Fitzpatrick, Cella, Harper & Scinto

(57) ABSTRACT

A sheet feeding apparatus in that a leading edge regulation member, which is provided on an end on a downstream in a sheet feeding direction of a manual feed tray tilted in such a manner that a portion of the manual feed tray on the downstream in the sheet feeding direction is lowered, regulates a position of an edge on the downstream in the sheet feeding direction of a sheet bundle supported by the manual feed tray. Further, an upper end portion of the leading edge regulation member is provided with a stepped portion, to thereby cause sheets in a surface layer portion of the sheet bundle, which are supported by the manual feed tray, to deviate downstream in the sheet feeding direction when the sheet bundle is placed in the manual feed tray.

8 Claims, 5 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, and more particularly, to a structure of a regulation member for regulating a position of a leading edge in a sheet feeding direction of a sheet bundle supported by a sheet supporting portion.

2. Description of the Related Art

A conventional image forming apparatus such as a printer, a copying machine, or a facsimile includes a sheet feeding apparatus for separating sheets one by one and feeding each of the sheets to an image forming portion. As the conventional sheet feeding apparatus, for example, as described in U.S. Pat. No. 6,260,840, there is known a sheet feeding apparatus of the following type. Specifically, the sheet feeding apparatus feeds the sheets, which are placed in a tilted tray, one by one through a paper feed roller, and regulates a position of the sheets in such a manner that a leading edge of a sheet bundle is caused to abut against a portion of the tray, the portion being situated on a downstream side in a sheet feeding direction. Note that, in the sheet feeding apparatus, a tilted portion is provided in vicinity of the paper feed roller of an abutment portion against which the leading edge of the sheet bundle abuts. In this manner, the upper sheets enter into a side of the paper feed roller more easily. As the sheet feeding apparatus for feeding the sheets, which are placed in the above-mentioned tilted tray, one by one through the paper feed roller, the following manual feeding apparatus is generally used. Specifically, the manual feeding apparatus is provided on a side surface of an image forming apparatus main body, for feeding the sheets manually placed therein. Note that, for the manual feeding apparatus, stronger demand from users is posed on easily feeding sheets of various types (size, surface property, thickness, material, and the like) rather than feeding a large number of sheets of the same type.

FIG. 4 is a view illustrating a structure of the conventional manual feeding apparatus described above. A sheet S is placed on a tilted tray 42. When a feeding signal is received from a controlling unit (not shown), a pressure plate 42*a*, which is provided on a side of a proximal end of the tray 42, rotates to a direction indicated by the arrow E. As a result, due to an elastic force of a spring 43, an upper surface on a side of a leading edge of a sheet bundle SA is pressed against a sheet feed roller 51. Next, when the sheet feed roller 51 is caused to rotate, an uppermost sheet S of the sheet bundle SA is fed. Note that, by causing the pressure plate 42*a* to rotate in a direction opposite to the direction indicated by the arrow E to thereby return to an initial position after one sheet S is fed as described above, the double feed of sheets S is prevented. Here, when the sheet S is fed by the sheet feed roller 51, two or more sheets S may be fed at one time. In this regard, in order to prevent the double feed of sheets S, the conventional sheet feeding apparatus incorporates a torque limiter, and brings a separation roller 53 into pressure contact with the sheet feed roller 51, the separation roller 53 rotating in a sheet returning direction. The above-mentioned separation roller 53 is provided, and hence, in a case where the two or more sheets are fed, it is possible to separate the sheets fed together at one time, one by one due to a returning force of the separation roller 53 and to feed each of the sheets.

In the conventional sheet feeding apparatus described above, when a user places the sheet bundle on the tray, the sheet bundle is slid downward by gravity along the declination of the tray because the tray is tilted. Then, as illustrated in FIG. 5A, the leading edge of the sheet bundle SA abuts against a leading edge regulation member 54 of the tray 42, the leading edge regulation member 54 being provided on the downstream in the sheet feeding direction. With this, a stand-by position of the sheet bundle SA before feeding is determined. Note that, when the feeding signal is thereafter received as described above, the pressure plate 42*a* rotates in the direction indicated by the arrow E of FIG. 5A, and presses the upper surface on the side of the leading edge of the sheet bundle SA against the sheet feed roller 51. The sheet feed roller 51 is caused to rotate to feed the uppermost sheet.

Here, in a case where a frictional coefficient of the surface of the sheet is low, or in a case where a smoothness of the surface of the sheet is high, the sheets may stick to each other. In this case, even if the sheet feed roller 51 is caused to rotate in a direction indicated by the arrow F of FIG. 5B, it is sometimes impossible to smoothly separate and feed the uppermost sheet S of the sheet bundle SA. In particular, in a case where a smoothness of the surface of the sheet is high, an attractive force between the sheets increases, and hence it becomes difficult to separate the sheet bundle. Further, the above-mentioned tendency becomes more marked under a high-temperature and high-humidity environment.

Further, in a case where the sheet is cardboard having a basis weight of more than 250 g/m$^2$, or in a case where the sheet is a sheet having a size larger than an A3 size, the sheet bundle SA to be stacked on the tray 42 becomes heavier. Further, as the sheet bundle SA becomes heavier, there decreases a pressing force of pressing the sheet against the sheet feed roller 51 by use of the spring for biasing the pressure plate 42*a*. As a result, a conveying force (force of feeding the sheet) through the sheet feed roller 51 decreases, and feeding failure occurs more easily when the sheets stick to each other. Note that, though a countermeasure thereof is taken by increasing the elastic force of the spring 43, there is a fear that a so large number of sheets are fed together at one time that a separation portion on the downstream is incapable of separating the sheets in a case where thin paper having low basis weight is used. That is because, in the case where the thin paper having the low basis weight is used, the pressing force of pressing the sheet against the sheet feed roller 51 increases and thus the force of feeding the sheet becomes extremely large.

In addition, as illustrated in FIG. 5A, the leading edge of the sheet bundle SA abuts against the leading edge regulation member 54. Therefore, as the sheet bundle SA becomes heavier, also an abutting pressure between the sheet bundle SA and the leading edge regulation member 54 increases. Further, when the abutting pressure increases as described above, a frictional resistance between the leading edge of the sheet bundle SA and the leading edge regulation member increases. Thus, the pressure plate 42*a* cannot be smoothly moved anymore in the direction indicated by the arrow E. As a result, there may pose a problem that the pressing force decreases or that a point in time of pressing the sheet against the sheet feed roller 51 is delayed. In this case, the sheet feeding failure occurs more easily when the sheets stick to each other. In addition, in the image forming apparatus, there is a demand of decreasing occupation area thereof. Therefore, there is tendency to increase a tilted angle (angle with respect to a horizontal plane) of the tray 42 of the manual feeding apparatus provided on the side surface of the apparatus main body, to thereby decrease a protruding amount of the tray 42. However, when the tilted angle is increased as described above, the abutting pressure of the leading edge of the sheet bundle with respect to the leading edge regulation member 54 increases, and hence the feeding failure occurs more easily.

SUMMARY OF THE INVENTION

Therefore, the present invention has been made in view of the above-mentioned circumstance, and it is an object of the present invention to provide a sheet feeding apparatus, which is capable of reliably feeding a sheet irrespective of basis weight of the sheet and the like even in a case where a tilted tray is used, and to provide an image forming apparatus including the sheet feeding apparatus.

According to the present invention, there is provided a sheet feeding apparatus, including: a sheet supporting portion tilted in such a manner that a portion of the sheet supporting portion on a downstream side in a sheet feeding direction is lowered; and a feed roller configured to bring a sheet bundle supported by the sheet supporting portion into pressure contact with the feed roller, to thereby feed the sheet. In the sheet feeding apparatus, the sheet supporting portion includes: a rising and lowering sheet stacking member configured to support the sheet bundle and to bring the supported sheet bundle into pressure contact with the feed roller; a regulation member provided on the downstream in the sheet feeding direction with respect to the sheet stacking member and configured to regulate a position of an edge on the downstream side in the sheet feeding direction of the sheet bundle supported by the sheet stacking member; and a stepped portion provided on an abutment surface of the regulation member against which the sheet bundle abuts and configured to cause an upper portion of the sheet bundle to deviate downstream in the sheet feeding direction.

Further features of the present invention will become apparent from the following description of exemplary embodiments with reference to the attached drawings.

DESCRIPTION OF THE EMBODIMENTS

Figure 1:
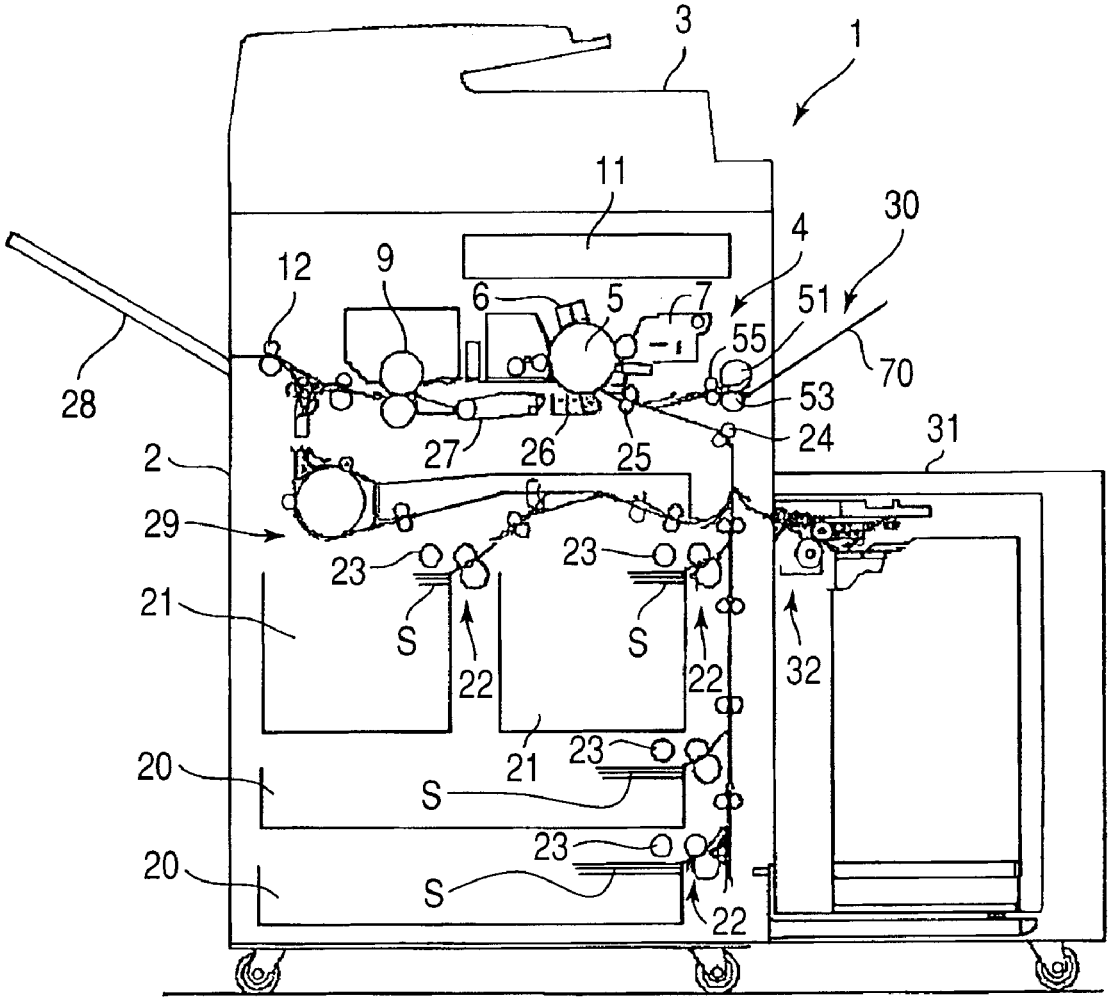
FIG. 1 is a view illustrating a structure of an image forming apparatus including a sheet feeding apparatus according to an embodiment of the present invention.

Hereinafter, an embodiment for implementing the present invention is described in detail with reference to FIG. 1 to FIG. 3B. FIG. 1 is a view illustrating a structure of an image forming apparatus including a sheet feeding apparatus according to an embodiment of the present invention. In FIG. 1, the image forming apparatus 1, an image forming apparatus main body 2, and an image reading apparatus 3 are provided. The image forming apparatus main body 2 is provided with: an image forming portion 4 configured to form an image on a sheet; a cassette feeding apparatus 22 configured to feed the sheet contained in cassettes 20, 21; and a manual paper feeding apparatus 30 serving as the sheet feeding apparatus configured to feed the sheet stacked on a manual feed tray 70. In addition, a deck 31 containing the sheet is coupled to the image forming apparatus main body 2. The image forming portion 4 includes a cylindrical photosensitive drum 5, a charger 6, a developing device 7, and the like. Further, on a downstream in a sheet feeding direction of the image forming portion 4, there are provided a fixing device 9, a discharge roller pair 12, and the like.

Next, an image forming operation of the image forming apparatus 1 structured as described above is described. When a controller (not shown) outputs an image forming signal, an image of an original (not shown) is read by the image reading apparatus 3, and read digital data is input into an exposure unit 11. Then, the exposure unit 11 irradiates the photosensitive drum 5 with a light according to the digital data. At this time, a surface of the photosensitive drum 5 has been uniformly charged by the charger 6. Therefore, when the exposure unit 11 irradiates the photosensitive drum 5 with the light as described above, an electrostatic latent image is formed on the surface of the photosensitive drum 5. When the electrostatic latent image is developed by the developing device 7, a toner image is formed on the surface of the photosensitive drum 5.

Meanwhile, when the controller outputs a paper feeding signal, in a case where the sheet is fed from the cassette, the sheet S contained in any one of the cassettes 20, 21 is first conveyed to a registration roller 25 through any one of sheet feed rollers 23 and through a conveying roller pair 24. Further, in a case where the sheet is fed from the deck 31, the sheet is conveyed to the registration roller 25 through a sheet feed roller 32 provided in the deck 31 and through the conveying roller pair 24. In addition, in a case of manual paper feeding, each of the sheets stacked on the manual feed tray 70 serving as a sheet supporting portion is conveyed to the registration roller 25 through the sheet feed roller 51 and a draw roller pair 55. In this case, the manual feed tray 70 is tilted in such a manner that a portion of the manual feed tray 70 on the downstream side in the sheet feeding direction is lowered. Both of the sheet feed roller 51 and the draw roller pair 55 are provided in the manual paper feeding apparatus 30. Note that, at this time, the registration roller 25 is held in a stopped state. By abutting the leading edge of the sheet against the registration roller 25 in the stopped state as described above, skew feed of the sheet is corrected.

After the skew feed of the sheet is corrected in the above-mentioned manner, the registration roller 25 is driven at such a point in time when the leading edge of the sheet corresponds to a leading edge of the toner image on the photosensitive drum 5. With this, the sheet is conveyed through the registration roller 25 to a transferring portion including a transferring-separating charger 26. Then, in the transferring portion, a transferring bias is applied to the sheet by the transferring-separating charger 26, and thus the toner image on the photosensitive drum 5 is transferred to a side of the sheet. Next, the sheet on which the toner image is transferred is conveyed through a conveyor belt 27 to the fixing device 9. After that, when the sheet is nipped and conveyed by a heating roller and a pressure roller of the fixing device 9, the toner image is thermally fixed. The sheet on which the toner image is fixed is discharged through the discharge roller pair 12 to the delivery tray 28. Note that, in a case of forming an image also on a back surface of the sheet, the sheet is conveyed to a two-side reversing device 29 after the toner image is fixed, and an image formation is performed again before the sheet is discharged to the delivery tray 28.

Figure 2A:
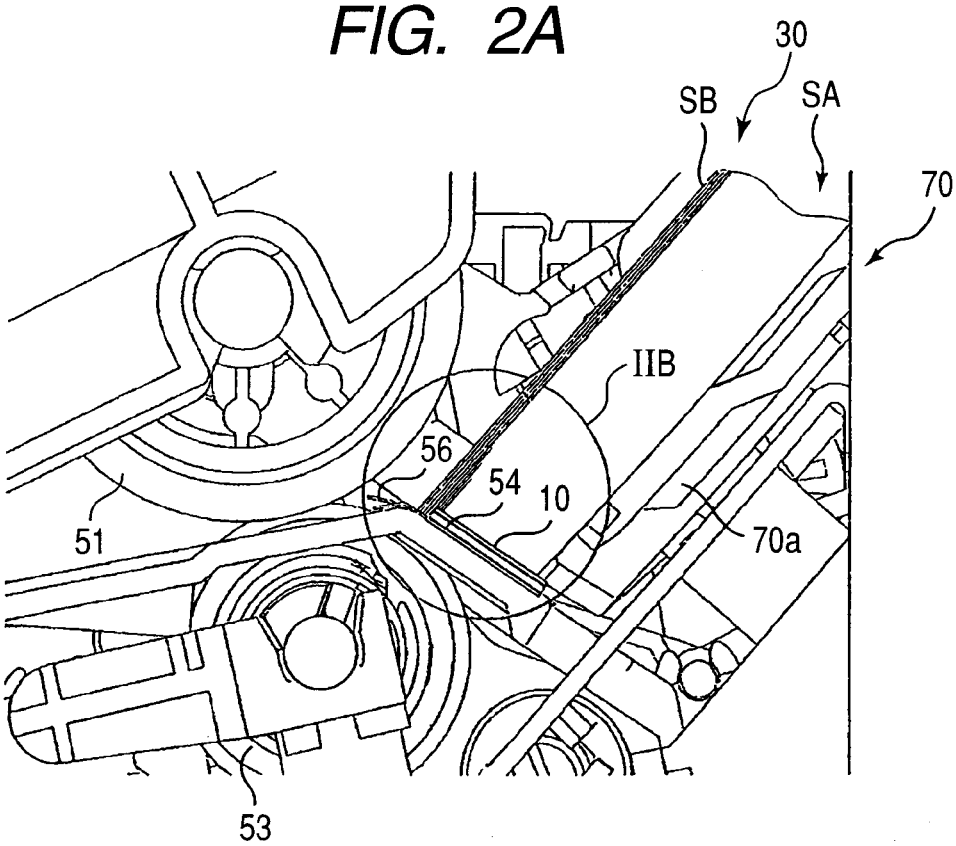
FIG. 2A is a view illustrating a structure of a manual paper feeding apparatus serving as the sheet feeding apparatus.

FIG. 2A is a view illustrating a structure of the manual paper feeding apparatus 30. A pressure plate 70*a* is provided on the downstream in the sheet feeding direction of the manual feed tray 70. A one end of the pressure plate 70*a* on the downstream side in the sheet feeding direction is raised by an elastic force of a spring (not shown) so that an upper surface of the sheet bundle SA supported by the pressure plate 70*a* is brought into pressure contact with the sheet feed roller 51. Note that, the pressure plate 70*a* is provided to be rotatable in an up and down direction (to be capable of rising and lowering), and the pressure plate 70*a* reiterates the rising and lowering every revolution of the sheet feed roller 51 through a cam (not shown) and the spring, to thereby feed the sheets one by one. In this case, the cam and the spring are interlocked with the rotation of the sheet feed roller 51. A leading edge regulation member 54 is provided on the downstream in the sheet feeding direction with respect to the pressure plate 70*a* serving as a sheet stacking member. The leading edge regulation member 54 serves as a regulation member against which the leading edge, which is a downstream side edge in the sheet feeding direction, of the sheet bundle SA which is slid down by gravity when the sheet bundle SA is placed on the tilted manual feed tray 70. Further, the sheet feed roller 51 incorporates a torque limiter, and a separation roller 53 is held in pressure contact with the sheet feed roller 51. In this case, a rotation drive in a sheet returning direction is transmitted to the separation roller 53. In addition, a separation assisting guide 56 is provided on an upstream of a separation nip portion serving as a pressure contact portion between the sheet feed roller 51 and the separation roller 53.

Figure 3A:
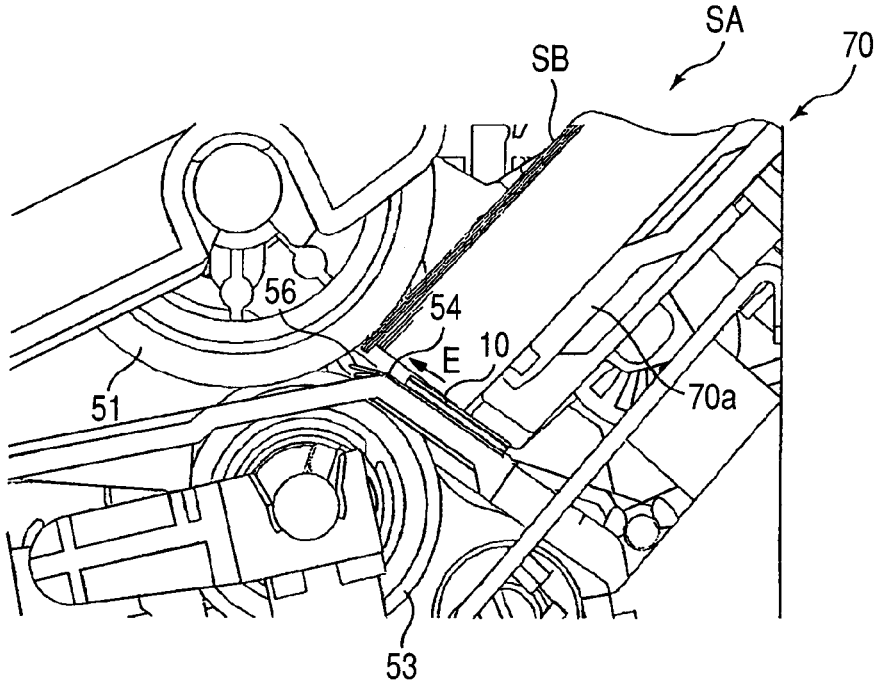
FIG. 3A and FIG. 3B are views illustrating a sheet feeding operation of the manual paper feeding apparatus.
Figure 3B:
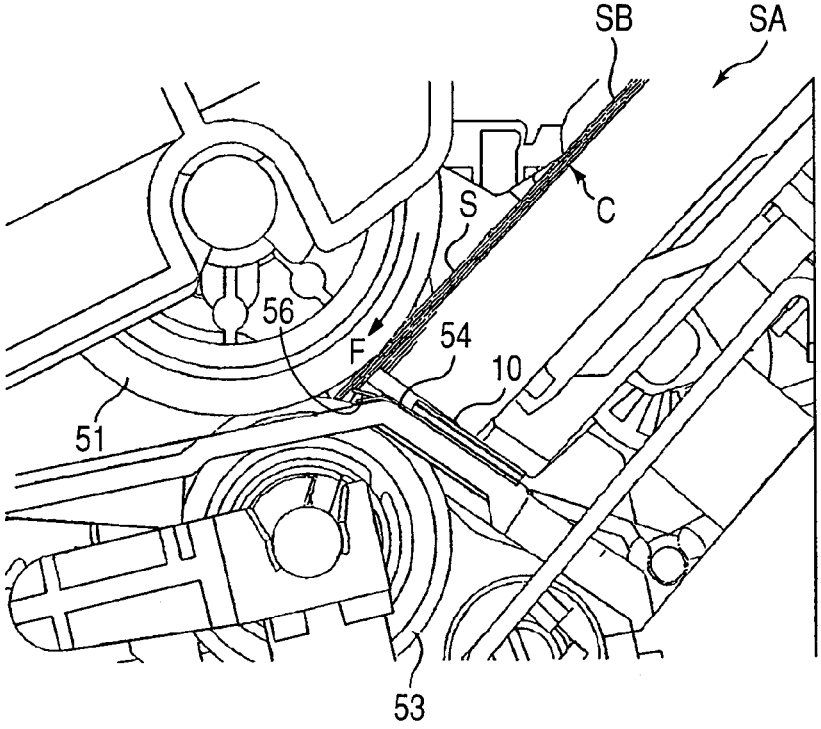
Figure 4:
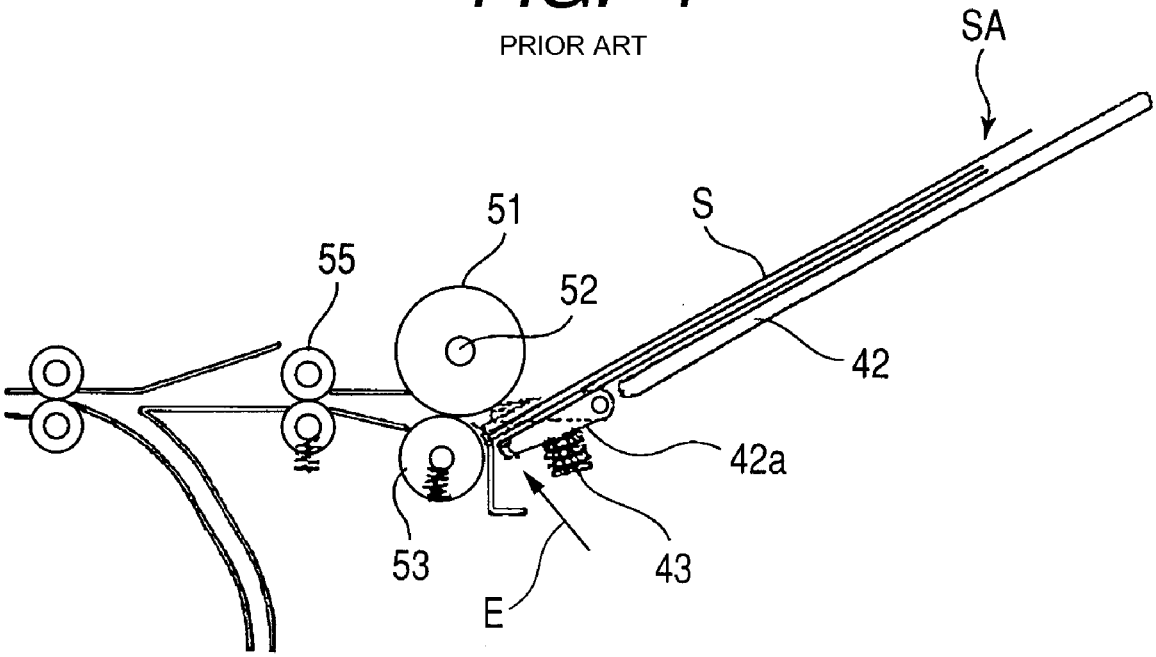
FIG. 4 PRIOR ART
FIG. 4 is a view illustrating a structure of a conventional manual paper feeding apparatus.
Figure 5A:
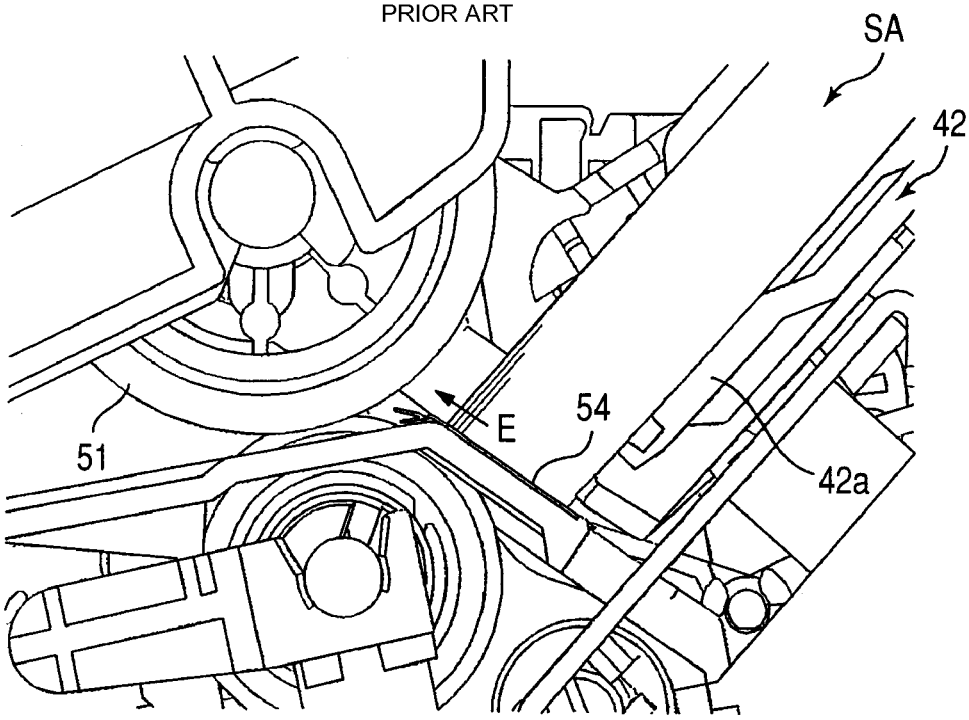
FIG. 5A PRIOR ART
FIG. 5A and FIG. 5B are views illustrating a sheet feeding operation of the conventional manual paper feeding apparatus.
Figure 5B:
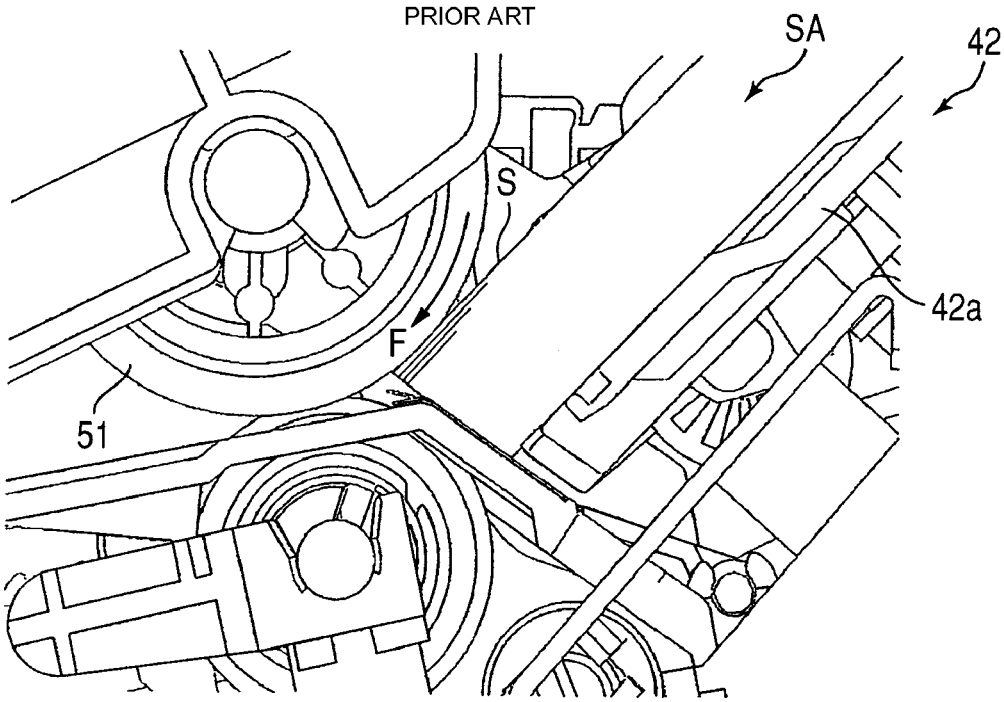
FIG. 5B PRIOR ART

In the manual paper feeding apparatus 30 structured as described above, in order to feed the sheets, the user places the sheet bundle SA onto the manual feed tray 70, and then the sheet bundle SA is slid downward by gravity along the declination of the manual feed tray 70. As a result, the sheet bundle SA abuts against the leading edge regulation member 54. With this, a position of the leading edge of the sheet bundle SA is regulated. Then, when a feeding signal is received from a controlling portion (not shown), the pressure plate 70*a*, as illustrated in FIG. 3A, moves upwardly (rises) by the elastic force of the spring in a direction indicated by the arrow E. As a result, the upper surface of the leading edge side of the sheet bundle SA stacked on the manual feed tray is pressed against a circumferential surface of the sheet feed roller 51. Next, as illustrated in FIG. 3B, the sheet feed roller rotates in a direction indicated by the arrow F, and thus the uppermost sheet S is fed. Here, in a case where multiple sheets S are fed together at one time (double feed) by the sheet feed roller 51, the sheets S fed together at one time abuts against the separation assisting guide 56 provided on an upstream of the separation nip portion. In this manner, the number of the sheets, which are to enter the separation nip portion, is limited to some extent. Then, under a state in which the number of the sheets of the double feed is limited through the separation assisting guide 56 as described above, the sheets of the double feed enter the separation nip portion. Then, the sheets of the double feed other than the uppermost sheet are caused to return to the manual feed tray 70 due to the returning force of the separation roller 53.

Figure 2B:
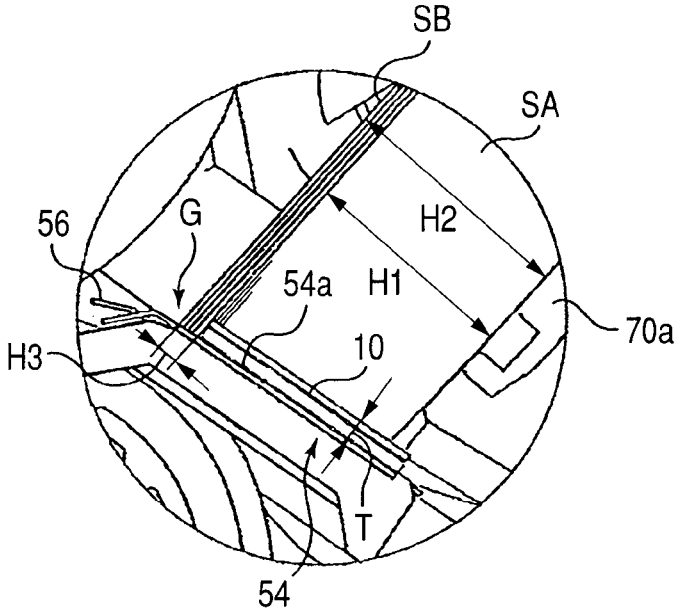
FIG. 2B is an enlarged view of encircled area IIB in FIG. 2A.

By the way, in a case where, for example, the sheet having a basis weight exceeding 250 g/m$^2$, a high smoothness and a low frictional coefficient of the surface, and a size larger than A3 size is fed under a high-temperature and high-humidity environment, a sticking force between the sheets increases. Therefore, it becomes difficult to separate and feed the sheets one by one. With this regard, in this embodiment, in order to reliably separate and feed the sheets one by one even in a case of the sheets having high basis weight and large size as described above, a sheet-shaped assisting member 10 is, as illustrated in FIG. 2B, provided and attached to a sheet abutment surface 54*a* of the leading edge regulation member 54 which abuts against the sheet bundle SA. Note that, the assisting member 10 has a predetermined thickness T. Further, a height H1 of the assisting member 10 in a sheet stacking direction, that is, the height H1 of the assisting member 10 from a surface of the sheet supporting portion is lower than a maximum sheet stacking height H2 of the manual feed tray 70. In a case where the above-mentioned assisting member 10 is provided on the leading edge regulation member 54, a stepped portion G is formed in an upper end portion of the sheet abutment surface 54*a*, which abuts against the sheet bundle SA, of the leading edge regulation member 54.

Here, in a case where the stepped portion G is formed in the upper end portion of the leading edge regulation member 54 as described above, when the sheet bundle SA is placed, the sheets other than multiple sheets (hereinafter, referred to as surface layer portion sheets) SB in a surface layer portion being an upper portion of the sheet bundle SA abut against the assisting member 10 and are held at a stand-by position. Meanwhile, the surface layer portion sheets SB, which correspond to a difference H3 between the height H1 of the assisting member 10 in the sheet stacking direction and the maximum sheet stacking height H2 of the manual feed tray 70, project to the downstream in the sheet feeding direction by an amount corresponding to the thickness T of the assisting member 10, and abut against the leading edge regulation member 54. That is, the assisting member 10 is provided on the leading edge regulation member 54 so as to form the stepped portion G in the upper end portion of the leading edge regulation member 54, and thus, when the sheets are placed in the manual feed tray 70, deviation (offset) of the surface layer portion sheets SB occurs in the sheet bundle SA in the sheet feeding direction.

In order to feed the sheets, the feeding signal is received from the controlling portion (not shown), and then the pressure plate 70*a* is moved in the direction indicated by the arrow E. At this time, even if the sheet bundle SA is caused to abut against the sheet feed roller 51, on an assumption that shapes of the sheet bundle SA and the surface layer portion sheets SB are kept, the surface layer portion sheets SB are reliably separated from the sheet bundle SA by the assisting member 10 as illustrated in FIG. 3A. Therefore, when the sheet feed roller 51 is caused to rotate in the direction indicated by the arrow F in FIG. 3B under the above-mentioned state, the surface layer portion sheets SB of the sheet bundle SA are fed. With this, even in a case where the sheets of the sheet bundle SA stick to each other, a resistance generated upon feeding the sheet bundle is reduced in comparison with the conventional apparatus. Therefore, it is possible to prevent feeding failure from occurring. Note that, the surface layer portion sheets SB fed as described above abut against the separation assisting guide 56 and are limited in the number to enter the separation nip portion, and then the sheets limited in the number enter the separation nip portion. Meanwhile, the sheets other than the uppermost sheet are returned to a front of the separation nip portion due to the returning force of the separation roller 53.

As described above, in this embodiment, the assisting member 10 is provided on the leading edge regulation member 54 so as to form the stepped portion G in the upper end portion of the leading edge regulation member 54. Therefore, even in a case where the sheets stick to each other, it is possible to reliably feed the sheet. That is, the upper end portion of the leading edge regulation member 54 is provided with the stepped portion for causing the upper portion of the sheet bundle, which is supported by the manual feed tray 70, to deviate downstream in the sheet feeding direction, and hence, even in a case where the tilted manual feed tray 70 is used, it is possible to reliably feed the sheet irrespective of the basis weight and the like. Further, deviation of the surface layer portion of the sheet bundle occurs not only when the sheets are placed, but also when a sheet feeding operation is continuously performed. Specifically, the deviation of the surface layer portion of the sheet bundle when the sheet feeding operation is continuously performed occurs in a continuous manner due to impact, the impact being generated when the sheet bundle SA is caused to abut against the sheet feed roller 51 by the pressure plate 70*a* repeatedly rising and lowering. As a result, also during a feeding operation, it is possible to cause the upper portion of the sheet bundle to deviate downstream in the sheet feeding direction.

Note that, in a case where the thickness T of the assisting member 10 is small, the deviation of the surface layer portion of the sheet bundle does not occur easily. When a sheet-shaped member having a thickness of at least 0.6 mm or more, preferably about 1 mm is attached as the assisting member 10 to the leading edge regulation member 54, definite deviation (offset or shift) of the surface layer portion of the sheets was experimentally confirmed. Further, the difference H3 is preferably set to about 1 mm. For example, the sheet having a basis weight of 250 g/m$^2$ or more has a thickness of about 250 μm, and hence, in a case where the difference H3 is set to about 1 mm, about three or four sheets are used as the surface layer portion sheets SB. Further, if the above-mentioned number of sheets are used as the surface layer portion sheets SB, even in a case where the multiple sheets are fed together at one time (double feed), it is possible to reliably separate and feed the sheets one by one. Note that, even in a case where relatively thin and light sheet having a basis weight of less than 80 g/m$^2$, it is possible, through a placing operation by the user or the feeding operation itself, to generate the deviation of the surface layer portion of the sheet bundle and to prevent the sheets from being fed together at one time.

Further, in this embodiment, a surface of the assisting member 10, which abuts against a portion other than the surface layer portion sheets of the sheet bundle SA, that is, the portion other than the upper portion of the sheet bundle, is set to have a frictional coefficient lower than a frictional coefficient of the sheet abutment surface 54*a* of the leading edge regulation member 54 which abuts against the surface layer portion sheets SB. With this setting, even in a case where the sheet bundle SA is heavy and an abutting pressure between the sheet bundle SA and the leading edge regulation member 54 increases, it is possible to smoothly perform the movement of the pressure plate 70*a*. As a result, it is possible to prevent the feeding failure from occurring. Note that, the sheet-shaped member made of a material having a low frictional coefficient is generally expensive, and hence, a double layer structure may be employed to the assisting member 10 as follows, to thereby reduce cost. Specifically, the sheet-shaped member having a low frictional coefficient may be used only in a portion of the assisting member 10 abutting against the sheet bundle and another portion of the assisting member may be made of a material different from a material constituting the above-mentioned portion. In addition, in this embodiment, the assisting member 10 being the sheet-shaped member is attached to the leading edge regulation member 54 so as to form the stepped portion at a regulating position, to thereby generate the deviation of the surface layer portion of the sheet bundle. However, a shape of a conveying guide or the leading edge regulation member may be improved so as to form the stepped portion. Further, in this embodiment, though the upper end portion of the leading edge regulation member 54 is provided with the stepped portion including a single step, the present invention is not limited thereto, and the stepped portion may be formed in a shape of stairs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-163754, filed Jul. 10, 2009 which is hereby incorporated by reference herein in its entirety.

What is claimed is:

1. A sheet feeding apparatus, comprising:

a sheet stacking member tilted in such a manner that a portion of the sheet stacking member on a downstream side in a sheet feeding direction is lowered;

a raising and lowering mechanism configured to raise and lower the sheet stacking member;

a feed roller with which a sheet bundle supported on the sheet stacking member raised by the raising and lowering mechanism is brought into pressure contact, to thereby feed the sheet; and a regulation member provided on the downstream in the sheet feeding direction with respect to the sheet stacking member and configured to regulate a position of an edge on the downstream side in the sheet feeding direction of the sheet bundle supported on the sheet stacking member; and a stepped portion fixed on an abutment surface of the regulation member against which the sheet bundle abuts, a height of the stepped portion in a sheet stacking direction from a surface of the sheet stacking member being lower than a maximum sheet stacking height of the sheets stacked on the sheet stacking member in a state that the sheet stacking member is lowered by the raising and lowering mechanism, wherein an abutment surface of the stepped portion is at a different level from the abutment surface of the regulation member in the sheet feeding direction, and when the sheet bundles are set to the sheet stacking member in the state that the sheet stacking member is lowered, the stepped portion causes an upper portion of the sheet bundle to deviate downstream in the sheet feeding direction.

2. A sheet feeding apparatus according to claim 1, wherein, in the abutment surface of the regulation member, a surface abutting against a portion other than the upper portion of the sheet bundle has a frictional coefficient lower than a frictional coefficient of a surface abutting against the upper portion of the sheet bundle.

3. A sheet feeding apparatus according to claim 1, wherein the regulation member is attached with a sheet-shaped member having a frictional coefficient lower than a frictional coefficient of the abutment surface of the regulation member against which the sheet bundle abuts, so that the stepped portion is formed.

4. A sheet feeding apparatus according to claim 1, wherein the stepped portion is formed in a shape of stairs.

5. An image forming apparatus, comprising:

a sheet feeding apparatus comprising:

a sheet stacking member tilted in such a manner that a portion of the sheet stacking member on a downstream side in a sheet feeding direction is lowered;

a raising and lowering mechanism configured to raise and lower the sheet stacking member;

a feed roller with which a sheet bundle supported on the sheet stacking member raised by the raising and lowering mechanism is brought into pressure contact, to thereby feed the sheet;

a regulation member provided on the downstream in the sheet feeding direction with respect to the sheet stacking member and configured to regulate a position of an edge on the downstream side in the sheet feeding direction of the sheet bundle supported on the sheet stacking member; and a stepped portion fixed on an abutment surface of the regulation member against which the sheet bundle abuts, a height of the stepped portion in a sheet stacking direction from a surface of the sheet stacking member being lower than a maximum sheet stacking height of the sheets stacked on the sheet stacking member in a state that the sheet stacking member is lowered by the raising and lowering mechanism, wherein an abutment surface of the stepped portion is at a different level from the abutment surface of the regulation member in the sheet feeding direction, and when the sheet bundles are set to the sheet stacking member in the state that the sheet stacking member is lowered, the stepped portion causes an upper portion of the sheet bundle to deviate downstream in the sheet feeding direction.

6. An image forming apparatus according to claim 5, wherein, in the abutment surface of the regulation member, a surface abutting against a portion other than the upper portion of the sheet bundle has a frictional coefficient lower than a frictional coefficient of a surface abutting against the upper portion of the sheet bundle.

7. An image forming apparatus according to claim 5, wherein the regulation member is attached with a sheet-shaped member having a frictional coefficient lower than a frictional coefficient of the abutment surface of the regulation member against which the sheet bundle abuts, so that the stepped portion is formed.

8. An image forming apparatus according to claim 5, wherein the stepped portion is formed in a shape of stairs.

* * * * *